US006170707B1

(12) United States Patent
Wolski et al.

(10) Patent No.: US 6,170,707 B1
(45) **Date of Patent: *Jan. 9, 2001**

(54) REMOTE JUICE DISPENSER

(75) Inventors: Peter F. Wolski, Algonquin; Michael S. Long, Wauconda; William W. Segiet, Jr., Chatham, all of IL (US)

(73) Assignee: IMI Cornelius Inc., Anoka, MI (US)

( * ) Notice: Under 35 U.S.C. 154(b), the term of this patent shall be extended for 0 days.

This patent is subject to a terminal disclaimer.

(21) Appl. No.: 09/286,224

(22) Filed: Apr. 5, 1999

Related U.S. Application Data

(63) Continuation of application No. 08/695,619, filed on Aug. 12, 1996, now Pat. No. 5,890,626.

(51) Int. Cl.[7] ..... B67D 5/62
(52) U.S. Cl. ..... 222/129.1; 222/146.6
(58) Field of Search ..... 222/105, 129.1, 222/145.6, 146, 214

(56) References Cited

U.S. PATENT DOCUMENTS 4,781,310 * 11/1988 Credle, Jr. et al. ..... 222/129.1
5,564,601 * 10/1996 Cleland et al. ..... 222/129.1
5,890,626 * 4/1999 Wolski et al. ..... 222/146.6

* cited by examiner

*Primary Examiner*—Philippe Derakshani
(74) *Attorney, Agent, or Firm*—Sten Erik Hakanson

(57) ABSTRACT

A juice dispensing system which includes a first station and a second station is provided. The first station includes a housing and dispensing valve extending therefrom for dispensing juice product into a cup. The dispensing valve includes an inlet for receiving water and juice concentrate, mixes the water and the concentrate to form the product and then dispenses the juice product. A first conduit extends through the housing to provide water to the inlet at the dispensing valve, while a second conduit provides juice concentrate to the inlet supply at the dispensing valve. The juice concentrate is stored in a juice concentrate reservoir at a second station, the second station being at a remote distance from the first station. A peristaltic pump is disposed within the second conduit for creating a suction which draws the juice concentrate from the juice concentrate reservoir and further meters the juice concentrate to the dispensing valve. The peristaltic pump is located within the housing of the juice dispenser at the first station.

8 Claims, 5 Drawing Sheets

REMOTE JUICE DISPENSER

The present application is a continuation of application Ser. No. 08/695,619, filed Aug. 12, 1996, now U.S. Pat. No. 5,890,626, issued Apr. 4, 1999.

The present invention relates to the art of juice dispensers and more particularly to an improved juice dispenser having juice concentrate stored in a remote location.

BACKGROUND OF THE INVENTION

An apparatus (juice dispenser) for reconstituting citrus fruit or vegetable juice concentrate, such as orange juice concentrate, with water (preferably cold tap water) and dispensing the reconstituted fruit juice into a cup is well known in the prior art. Such juice dispensers must be adapted to operate efficiently with a citrus fruit juice concentrate which carries pulp and other solids, presenting unique problems preventing efficient flow. Furthermore, dispensing of the pulp solids evenly is an object of juice dispensers. Thus, straining out or removing the pulp or solids is not a viable option.

Generally, a juice dispensing apparatus includes a dispensing tower having a plurality of mixing valves which operate to mix independent inflows of water and juice concentrate, control the brix of the mixed product and dispense the product into a cup or glass. The dispensing tower generally includes a cooling system which is either the mechanically refrigerated type or the cold plate type. The mechanically refrigerated type uses refrigerant-filled coils to. form an ice bank which is surrounded with conduit coils through which water passes and is chilled. Generally, these coils are contained in a water bath for uniform cooling. The water conduit is connected to a water supply at one end, passes through the water bath within the dispensing tower and is connected to the dispensing valve at an opposite end. The cold plate cooler utilizes an aluminum block or plate of similar metal in which the water conduits are embedded. Ice is placed in contact with the aluminum block. The ice cools the block, which in turn, cools the water within the block. The cold plate is also embedded in insulation or a foamed insulation block as are the water conduits which lead from the cold plate to the dispensing valve. In a juice dispenser, it is not necessary to cool the concentrate because of the ratio of water to concentrate, the fact that the water is cooled independently.

In general, there are two types of juice dispensers. The first is a self-contained juice dispenser in which the dispensing tower includes mixing and dispensing valves, the cooling system for the water supply and a concentrate container within which fruit or vegetable juice concentrate is placed for later dispensation. A pump, typically a peristaltic pump, accurately meters the flow of the concentrate to the mixing valves. Typically, the juice concentrate reservoir is located above the dispensing valve, and vacuum and gravity feed moves the concentrate from the concentrate reservoir through a metering device, often a peristaltic pump, and to the dispensing valve.

It has also been proposed to provide a juice dispensing apparatus which uses either a venturi pump or aspirator or venturi action without the use of a mechanical pump. These systems utilize the energy from the pressure of the tap water supply system to draw fruit juice concentrate from a supply reservoir. Examples of these prior art systems include Jenkins 4,478,357 and Uttech 4,042,151, incorporated by reference herein.

The problems with large countertop drink dispensing units are well known. In many businesses, including for instance, the fast food industry, countertop space is at a premium. In order to maximize the efficiency and flow required in the fast food industry, as well as free valuable counter space, remote drink dispensing units have been used. Prior art remote dispensing units, most notably used for soft drinks, have numerous advantages. The drink dispensing tower usually only includes a number of handles, mixing valves or the like, which are operated to cause beverage components to flow from supplies at a remote location into a cup in which they are mixed to form the drink. Only the ice component of the drink need be stored in a location adjacent to the dispensing tower. An example of such remote drink dispensing units is seen in Neumann U.S. Pat. No. 3,853,244, incorporated by reference herein.

Other prior art apparatuses, especially those used for mixing and dispensing non-pulpy beverages, utilize a pump at the reservoir for pressurizing the syrup or concentrate to push the concentrate through the line and into the mixing and dispensing mechanism.

The advantages of such remote drink dispensing units include the ability to change the drink supply at a remote location without interfering with the flow of sales at a front counter or the ability of customers to serve themselves at a self-serve unit, such as during a lunch crowd. The space requirements of several large syrup canisters, as in the case of soft drinks, or bag-in-box reservoirs, as in the case of fruit juice concentrate, is great. Allowing drink dispensers to draw from the supplies, while the supplies are located in a back room, is of great advantage to many food industries. Remote drink dispensers are also significantly easier to operate, maintain and repair. The dispensing towers are smaller and compact and, especially in the case of certain juice dispensers, such as seen in McMillan U.S. Pat. No. 3,898,861 or Popinski U.S. Pat. No. 3,643,835, utilize storage tanks, either separate or as a part of the dispensing tower. The storage tanks need to be periodically filled and, importantly, need be cleaned and flushed with flushing water. Remote juice dispensers, including those using bag-in-box supply reservoirs for juice concentrate, make cleaning easier.

For definitional purposes, a bag-in-box supply reservoir, known in the art, comprises a corrugated cardboard box having a plastic or foil-lined bag therein which contains the fruit juice concentrate. A simple plastic valve, also well known in the art, is attached to a nipple opening in the bag, the plastic valve then being attached by a conduit to the juice dispenser.

In conventional remote juice dispensers, a juice reservoir, such as a bag-in-box, is located at a distance from the juice dispensing appliance such as the dispensing tower. The reservoir is teamed with a pump at the reservoir location which moves the juice concentrate from the reservoir to the dispensing tower. In such an embodiment, each juice reservoir must include its own pump which, in turn, supplies an individual dispensing valve at the dispensing tower. This design has certain inherent disadvantages.

The juice marketplace is very competitive. Retailers change juice vendors very frequently. When concentrate is bought from a different source, the previous vendor comes into the store location and removes his equipment. The new vendor then comes in and installs his own equipment. When juice concentrate pumps are located remotely from the dispensing appliance, they must first be removed by the first vendor and new, separate pumps installed by the second vendor. Not only does this make extra work, it involves extra bookkeeping for both vendors and store managers. Often, because the pumps are located at a remote location, they are not retrieved by the first vendor and are sometimes lost.

SUMMARY OF THE INVENTION

The present invention advantageously provides a remote juice dispenser which overcomes the disadvantages of prior art remote juice dispensers. The present invention provides a remote juice dispenser which provides a long-sought but unsolved need to provide a remote juice dispenser in which all components other than the disposable and inexpensive concentrate reservoir are contained within a single appliance.

More particularly in this respect, a remote juice dispensing system is provided in which the need for pumps at the reservoir location is eliminated. The present invention improves efficiency in the competitive juice marketplace. The invention allows retailers to continue to change juice vendors frequently. However, when juice concentrate is bought from a different source, the old vendor need only remove a single appliance at the countertop location. The extra pumps previously required at the reservoir location and often forgotten or lost are eliminated. Thus, the extra work, the bookkeeping and the cost associated with lost pumps is eliminated. A new juice vendor need only install a single appliance at the countertop and provide the concentrate reservoirs at the remote location. New pump power hookups are eliminated, maintenance problems are eliminated by eliminating additional moving parts and pumps. Further, the overall capital cost as well as maintenance costs of the dispensing appliance is reduced.

In accordance with one aspect of the present invention, a juice dispensing system is provided comprising a first station and a second station, the first station includes a single dispensing tower or appliance having a housing and a plurality of dispensing mechanisms for dispensing juice concentrate therefrom. The dispensing mechanism includes inlet supply hookups for receiving potable water and receiving juice concentrate as well as a mixer nozzle for mixing the water and juice concentrate within the dispensing mechanism. A dispensing or nozzle outlet allows the mixed products to be dispensed into a cup or glass. A first conduit, located within the housing, is connected to the inlet supply of the dispensing mechanism at one end, and is in turn hooked to a potable water supply at the other end. A second conduit is also provided at the inlet supply of the dispensing mechanism and an opposite end is connected to a supply hose for the juice concentrate. The juice concentrate is stored in a juice concentrate reservoir located at the second station, the second station being at a remote distance from the first station, which is preferably anywhere from 5 to 50 feet from the dispensing tower and the first station. In a preferred embodiment, a peristaltic pump is disposed within the second conduit. The peristaltic pump, through vacuum action, draws juice concentrate directly from the juice concentrate reservoir, meters the juice concentrate and pushes it to the dispensing mechanism. This peristaltic pump is located at the first station and preferably within the housing of the dispensing tower. Also included within the dispensing tower is a mechanism for chilling the water. In a preferred embodiment, it has been found that the invention is capable of drawing juice concentrate from a distance of 50 feet and from an elevation 10 feet below the pump.

It is thus an outstanding object of the present invention to provide a remote juice dispenser which eliminates pumps, compressors and other means of propelling the concentrate at the remote location adjacent the concentrate reservoir.

It is yet another object of the present invention to provide a remote juice dispenser utilizing a peristaltic pump to both meter concentrate flow and draw juice concentrate from a remote juice concentrate reservoir.

Still another object of the invention is to provide a remote juice dispenser which eases the removal and installation of competitive juice dispensers and eliminates lost or forgotten remote pumps.

Yet another object of the present invention is to provide a remote juice dispenser which provides all moving parts in a single compact countertop appliance.

A further object of the present invention is to provide a remote juice dispenser which reduces the overall cost of production, reduces maintenance requirements by reducing moving parts and reduces ongoing utility costs to operate the dispenser.

These and other objects of the invention will become apparent to those skilled in the art upon reading and understanding the detailed description in the following section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

PREFERRED EMBODIMENTS

Figure 1:
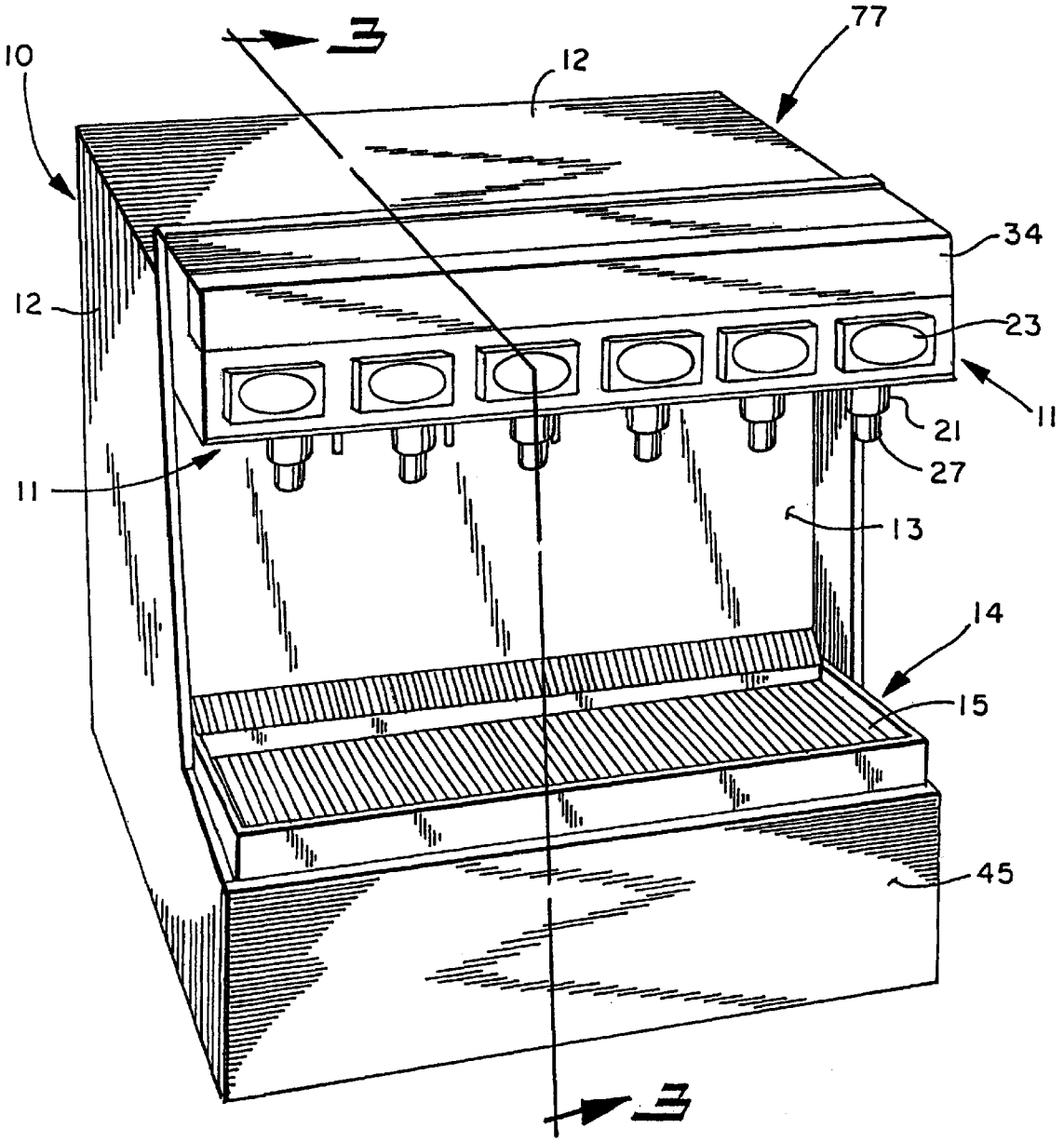
FIG. 1 is a pictorial view illustrating one element of the juice dispensing system of the present invention.
Figure 3:
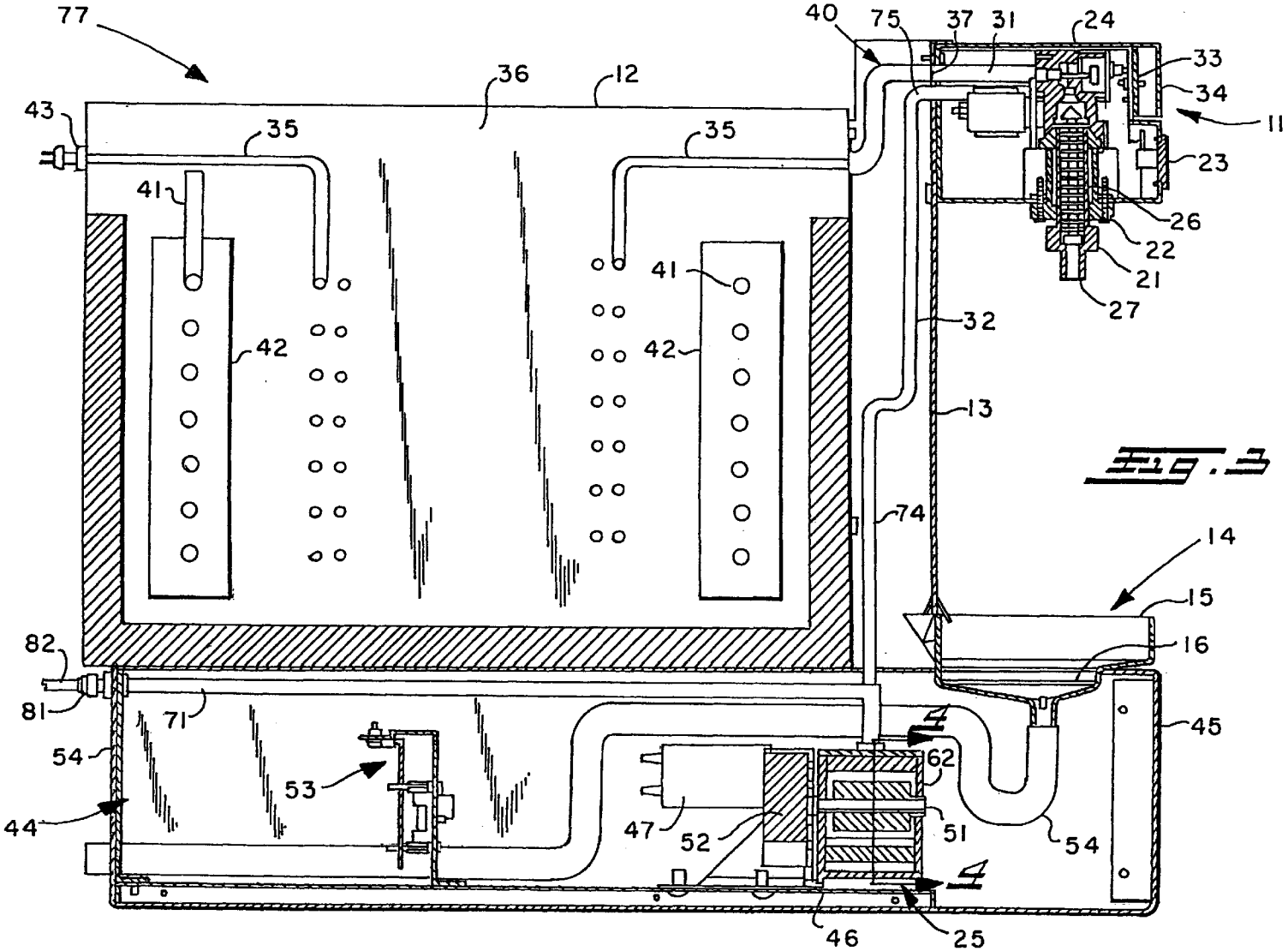
FIG. 3 is an elevation view, partially in cross-section, taken along line 3—3 of FIG. 1.

Referring to the drawings, wherein the showings are for the purpose of illustrating the preferred embodiments of the invention only and not for the purpose of limiting same, FIG. 1 shows a juice dispensing tower 10 designed to dispense juice from the dispensing valves 11 into a cup (not shown). Dispenser 10 includes a housing 12 which defines a cup platform 14 and a platform grill 15 which allows liquid not captured in a cup to pass through the platform grill 15 and into a spill reservoir 16, shown in FIG. 3. Each of dispensing valves 11 include a nozzle 21 which is secured to housing 12 by a nozzle bushing 22. Depression of a push button 23 by an operator activates nozzle 21 to direct a liquid product downwardly into a cup. The depression of the dispensing button 23 activates a brix control valve 24 and a peristaltic pump 25 to draw fruit juice or vegetable juice concentrate to a concentrate static mixer portion 26 of valve 11 where it is mixed with water to form juice product and ultimately dispensed from the opening 27 of nozzle 21.

At the same time brix control valve 24 is actuated, the peristaltic pump 25 is actuated and chilled water is dispensed from the water conduits 31, via a water valve outlet opening 37, into static mixer portion 26 of each of dispensing valves 11. Therein, it is mixed with juice concentrate released from a juice conduit 32. The juice product formed is then dispensed from opening 27. In order to adjust the brix and thus the ratio between juice concentrate and water, brix dial 33 is provided for adjustment behind a removable brix cover 34. As outlined, dispensing valves 11 are standard and will not be described in further detail.

Each water conduit 31 extends between the chilled water manifold 35 and one of the dispensing valves 11 shown in FIG. 1. Chilled water manifold 35 is coiled for maximum cooling effect within the chilled water reservoir 36. As shown, mechanical refrigeration means, i.e. evaporator tubing 41, is used to form the ice banks 42 which in turn cool a water bath within chilled water reservoir 36, thus adequately cooling supply water beginning at the water inlet coupling 43. It will be appreciated that chilled water reservoir 36 is provided with the insulation 40 at at least the front face 13 of housing 12. Generally the entire chilled water compartment is insulated. Chilled water manifold 35 and the mechanical refrigeration means are standard and will not be described in further detail.

Figure 2:
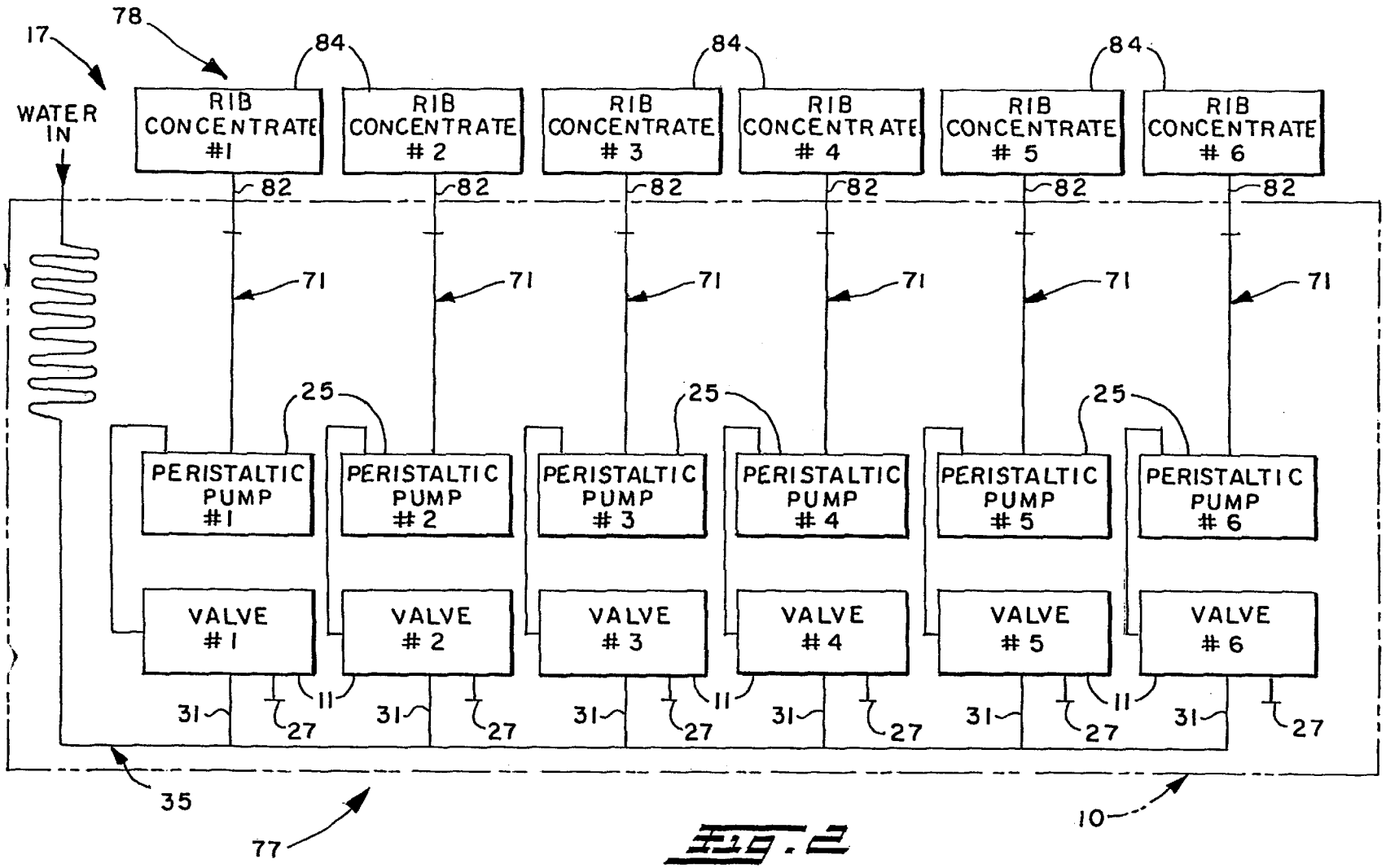
FIG. 2 is a flow diagram illustrating the juice dispensing system of the present invention.

Located below water manifold 35 is a pump housing 44. A removable front cover 45 provides at least partial access to the system therein. Mounted therein is peristaltic pump 25 on a support frame 46. A pump motor 47, drives a pump shaft 51 through a gear box 52. The pump drive electronics 53 actuate pump motor 47 when push button 23 is activated. As best seen in FIG. 2, each dispensing valve 11 is connected to an individual peristaltic pump 25 with the accompanying pump drive electronics 53. A drain tube 54 is also located within pump housing 44. Drain tube 54 leads from spill reservoir 16, through pump housing 44 and out through the back face 54 of pump housing 44 to a waste drain (not shown).

Figure 4:
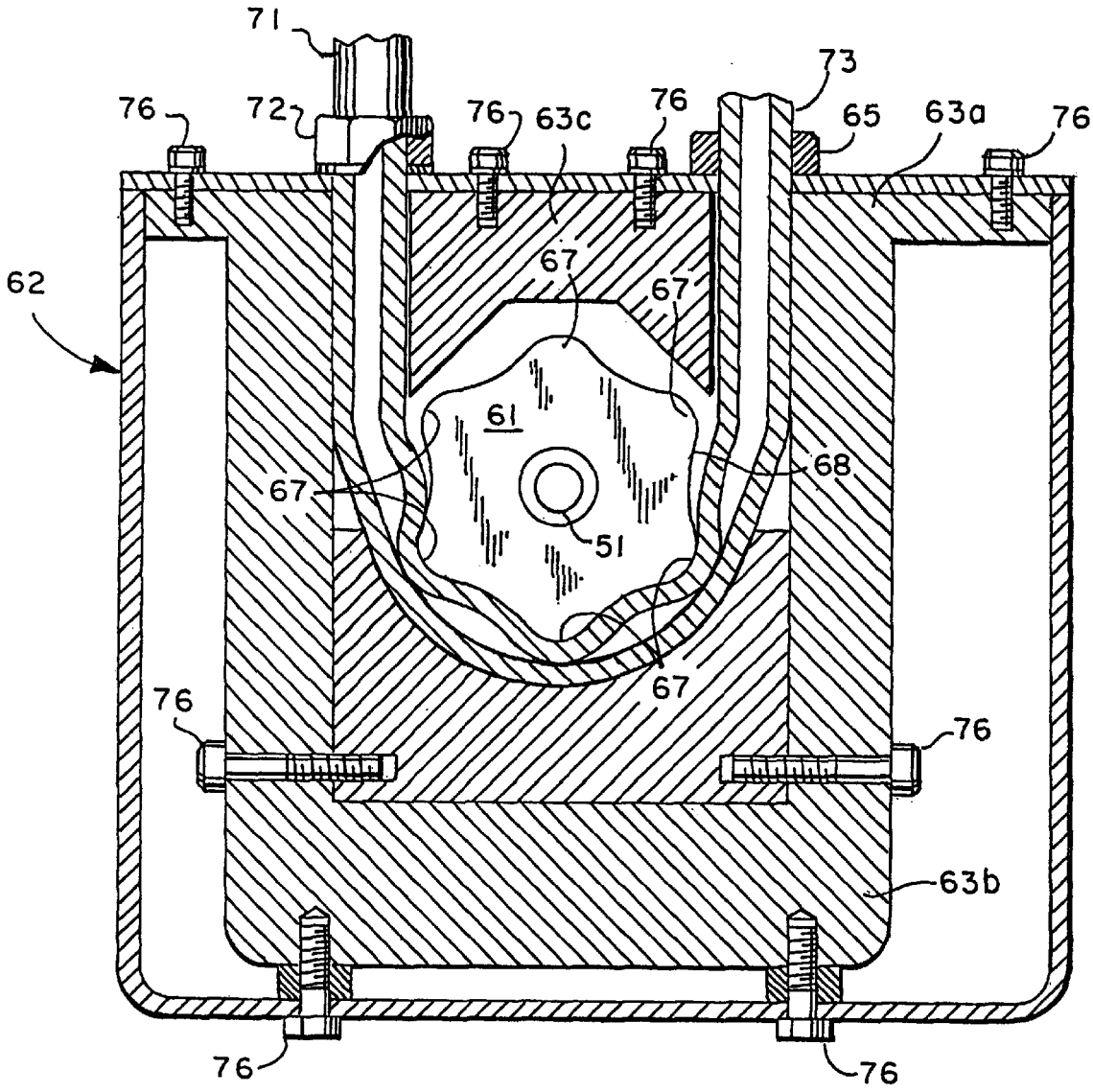
FIG. 4 is an elevation view, partially in cross-section, taken along line 4—4 of FIG. 3.

As is well known in the art, a peristaltic pump comprises a rotor 61, rotatably driven by pump drive shaft 51, which is supported for rotation within a peristaltic housing 62. The support blocks 63*a*, 63*b* and 63*c* are adapted to support an individual segment of a flexible tubing 65 which is placed in engagement with rotor 61, as shown in FIG. 4. Rotor 61, having the curvilinear projections 67 on the outer circumference 68, causes peristaltic pumping through tubing 65 by pinching tubing 65 between one of the curvilinear projections 67 and support block 63*b*. The curvilinear portions are often rollers.

A concentrate suction conduit 71 is connected to pump 25 at a coupling 72. Peristaltic pumping causes a vacuum or suction action within conduit 71 drawing concentrate. The pumping action also meters concentrate flow by collapsing tubing 65 between individual curvilinear projections 67 and feeds metered concentrate through outlet 73 into pump outlet tubing 74, which is in turn connected to concentrate valve inlet 75. It will be appreciated that support blocks 63*a*, 63*b* and 63*c*, are mounted within peristaltic housing 62 by cap screws 76, thus easing replacement of flexible tubing 65 when necessary. Peristaltic pump 25 and variations thereof are standard and well known in the art.

As thus described, dispensing tower 10 and the mechanics within housing 12 comprise a first station 77 for the juice dispenser system 17. As will now be described, the juice concentrate reservoir, located at a location remote from first station 77, comprises a second station 78.

Extending from a concentrate housing inlet fitting 81 is a concentrate suction tube 82. Concentrate suction tubing 82 is connected at a valve 83 to a bag-in-box juice concentrate reservoir 84. It will be appreciated that each of dispensing or mixing valves 11 is individually connected, through an individual peristaltic pump 25, to an individual bag-in-box concentrate reservoir 84, as best seen in FIG. 2. As discussed above, a bag-in-box concentrate reservoir consists of a corrugated cardboard box having a plastic or foil liner which is fitted with a nipple. Valve 83 attaches to the nipple (not shown) at one end and suction tube 82 at the other end.

Figures 5, 6:
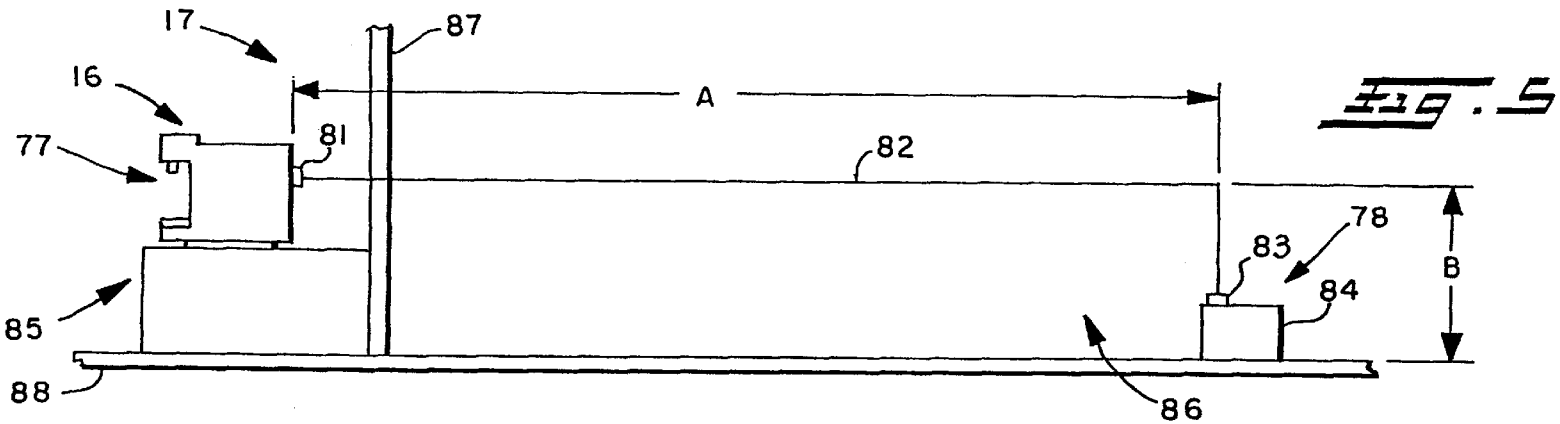
FIG. 5 is a pictorial view illustrating one embodiment of the present invention; and, FIG. 6 is a pictorial view illustrating another embodiment of the present invention.

As seen in FIGS. 2, 5 and 6, it has been surprisingly found that it is possible to advantageously eliminate any pump at the juice reservoir location. Peristaltic pump 25 is capable of drawing juice concentrate through suction tube 82 from bag-in-box concentrate reservoir 84 to a length generally around 50 feet, where dimension "A" in FIG. 5 is approximately 50 feet. It has been further found that juice dispensing system 17 can draw juice concentrate from bag-in-box concentrate reservoir 84 and develop 3 to 4 feet of head from 50 feet, where dimension "B" in FIG. 5 is generally equal to 3 feet. When suction tube 82 is somewhat less than 50 feet, a greater amount of head can be developed. For instance, as shown in FIG. 6, dimension "C" is equal to generally 25 feet. When the length of tube 82 is so reduced, it has been found that juice dispensing system 17 is capable of developing approximately 15 feet of head. Dimension "D" in FIG. 6 represents 15 feet of head. In practical terms, this allows juice dispenser 10 to be located within a restaurant serving area 85 for use by restaurant employees or restaurant customers, while juice reservoir 84 is located in a back storage room 86 behind a wall 87 where space is not at a premium and where empty reservoirs 84 may be changed easily and quickly. Alternatively, as shown in FIG. 6, juice reservoirs 84 may be located in a basement storage room 87 below the floor level 88 of restaurant 85 since system 17 and peristaltic pump 25 are capable of developing at least 15 feet of head.

The peristaltic action of the pump 25 alone provides drawing power moving concentrate from the bag-in-box 84 to the dispensing tower 10. In a typical prior art dispenser, concentrate was forced into the peristaltic pump by gravity from a reservoir directly above the pump or by an upstream pump.

The advantages of the present system are numerous. For instance, a juice dispenser may be removed at the end of its useful life in one piece. There is no need to worry about additional pumps in back rooms. With the high turnover of supply contracts, restaurants change vendors very frequently. With the short-term contracts, there is a great need to simplify the installation and removal of dispensing equipment without sacrificing the advantages of remote dispensing units. The present invention has surprisingly found that a peristaltic pump is capable of both metering juice concentrate as well as developing vacuum or suction within suction tube 82 such that juice concentrate can be drawn through approximately 50 feet of tubing and additionally develop 3 to 4 feet of head. Where shorter tubing is used, approximately 25 feet, it has been found that 15 feet of head can be developed, allowing bag-in-box storage at an elevation substantially below juice dispenser 10 and, as shown in FIG. 6, at a basement elevation. Thus, the present invention provides a remote juice dispensing system in which all components other than the disposable and inexpensive concentrate reservoirs are contained within a single dispensing appliance without sacrificing the advantages of a remote unit.

The invention has been described with reference to the preferred embodiments. Obviously, modifications and alterations other than those discussed herein will occur to those skilled in the art upon reading and understanding the invention. It is intended to include all such modification and alterations insofar as they come within the scope of the appended claims. or the equivalents thereof.

Having thus described the invention, it is claimed:

1. A juice dispenser for mixing a juice concentrate with potable water at a desired ratio there between and dispensing a resulting juice beverage of such desired ratio into a cup, the juice dispenser comprising:

a housing defining a dispenser exterior and interior, one or more beverage dispensing valves cured to the dispenser along a front portion of the exterior thereof, a water bath tank in the dispenser interior retaining therein a volume of water and an evaporator the evaporator connected to electro-mechanical refrigeration means for providing cooling of the evaporator for cooling the volume of water, a water conduit for providing fluid communication of the potable water from a source thereof to the one or more beverage dispensing valves and a portion of the water conduit passing through the water bath tank for providing heat exchange cooling of the potable water as it flows there through, one or more peristaltic pumps located within the dispenser interior, one or more first juice conduits for providing fluid connection between one or more remote sources of juice concentrate located exterior of the dispenser interior and one or more inlets of the one or more peristaltic pumps, and one or more second juice conduits providing for fluid connection between one or more outlets of the one or more peristaltic pumps and the one or more beverage dispensing valves, and the one or more peristaltic pumps providing the sole pumping energy for moving juice concentrate from the one or more sources thereof to the one or more beverage dispensing valves and providing for delivering of the juice concentrate thereto at a predetermined volumetric rate based on the rate of operation thereof to match a predetermined flow rate of the potable water so that the one or more beverage dispensing valves are of simple construction wherein no separate juice concentrate flow control is required therein and so that a resulting beverage at the desired ratio of juice concentrate to potable water is delivered to the corresponding nozzle for mixing therein and dispensing there from.

2. The juice dispenser as defined in claim 1, and the dispenser interior divided into an upper portion for containing the water bath tank and a lower portion for retaining the one or more peristaltic pumps.

3. The juice dispenser as defined in claim 2, and the one or more peristaltic pumps arranged in a line along a front portion of the interior lower portion adjacent a cup platform wherein the cup platform is positioned below the one or more beverage dispensing valves.

4. The juice dispenser as defined in claim 3, and the dispenser exterior including an access panel along a lower front surface portion of the dispenser exterior for permitting access to the one or more peristaltic pumps.

5. The juice dispenser as defined in claim 1, and the dispenser exterior including an access panel along a lower front surface portion of the dispenser exterior for permitting access to the one or more peristaltic pumps.

6. The juice dispenser as defined in claim 2, and the first one or more juice conduits routed through the interior lower portion.

7. The juice dispenser as defined in claim 3, and the first one or more juice conduits routed through the interior lower portion.

8. A method of dispensing a juice beverage from a juice dispenser, the juice dispenser comprising a housing defining a dispenser exterior and interior, a juice dispensing valve secured to the dispenser on a front portion of the exterior thereof, the juice dispensing valve having a mixing nozzle and an on/off mechanism for permitting flow of potable water out of the mixing nozzle thereof and stopping ouch flow respectively, a water flow control for regulating flow rate of the potable water to the juice dispensing valve, a water bath tank in the dispenser interior for retaining therein a volume of water and an evaporator, the evaporator connected to electro-mechanical refrigeration means, a water conduit for providing fluid communication of the potable water from a pressurized source thereof to the water flow control and from the water flow control to the juice dispensing valve and a portion of the water conduit contained in the water bath tank, a peristaltic pump located within the dispenser interior, a first juice conduit for providing fluid connection between a remote source of juice concentrate and an inlet of the peristaltic pump, the remote source of juice concentrate located exterior of the dispenser interior, a second juice conduit providing for fluid connection between an outlet of the peristaltic pump and the juice dispensing valve, the method of dispensing, comprising the steps of: cooling of the evaporator by operating the electro-mechanical refrigeration means for cooling the water in the water bath tank, operating the peristaltic pump to provide all the energy required for pumping the juice concentrate at a first desired flow rate from the remote source thereof to the mixing nozzle of the juice dispensing valve and simultaneously operating the juice valve on/off mechanism to the on position thereof for permitting a flow of the potable water from the pressurized source thereof through the water conduit and then through the flow rate control for cooling the potable water and delivering the potable water to the mixing nozzle of the juice dispensing valve at a second desired flow rate so that the potable water and juice concentrate are mixed together in the mixing nozzle and dispensed there from at the desired ratio there between forming the juice beverage.

* * * * *